US009056388B2

(12) United States Patent
Daday et al.

(10) Patent No.: US 9,056,388 B2
(45) Date of Patent: Jun. 16, 2015

(54) GRINDING LAMELLA FOR ARRANGEMENT ON A GRINDING WHEEL WHICH CAN BE DRIVEN IN ROTATION ABOUT AN AXIS OF ROTATION

(75) Inventors: Zoltan Atila Daday, Bergisch Gladbach (DE); Bernhard Runden, Bornheim (DE); Björn Edenharter, Engelskirchen (DE)

(73) Assignee: LUKAS-ERZETT VEREINIGTE SCHLEIF-UND FRASWERKZEUGFABRIKEN GMBH & CO. KG, Engelskirchen (DE)

( * ) Notice: Subject to any disclaimer, the term of this patent is extended or adjusted under 35 U.S.C. 154(b) by 151 days.

(21) Appl. No.: 13/881,904

(22) PCT Filed: Sep. 30, 2011

(86) PCT No.: PCT/EP2011/067144

§ 371 (c)(1),
(2), (4) Date: Jun. 26, 2013

(87) PCT Pub. No.: WO2012/055671

PCT Pub. Date: May 3, 2012

(65) Prior Publication Data

US 2013/0273822 A1 Oct. 17, 2013

(30) Foreign Application Priority Data

Oct. 26, 2010 (DE) ..... 20 2010 008 898 U

(51) Int. Cl.

| | |
|---|---|
| ***B24D 11/00*** | (2006.01) |
| ***B24D 3/00*** | (2006.01) |
| ***B24D 13/16*** | (2006.01) |

(52) U.S. Cl.
CPC ..... *B24D 3/00* (2013.01); *B24D 11/008* (2013.01); *B24D 13/16* (2013.01)

(58) Field of Classification Search
CPC ..... B24D 11/00; B24D 9/006; B24D 3/004; B24D 11/005; B24B 37/24
USPC ..... 451/548, 526, 527, 529, 530, 532, 533, 451/534, 544
See application file for complete search history.

(56) References Cited

U.S. PATENT DOCUMENTS

| | | | | |
|---|---|---|---|---|
| 269,688 | A * | 12/1882 | Levett | 15/230.14 |
| 1,697,442 | A * | 1/1929 | Webber | 451/537 |
| 5,405,286 | A * | 4/1995 | Welsch | 451/527 |
| 5,410,843 | A * | 5/1995 | Gottschald | 451/43 |

(Continued)

FOREIGN PATENT DOCUMENTS

| | | |
|---|---|---|
| DE | 29510727 U1 | 8/1995 |
| EP | 1142673 A2 | 3/2001 |

(Continued)

*Primary Examiner* — George Nguyen
(74) *Attorney, Agent, or Firm* — MacMillan, Sobanski & Todd, LLC

(57) ABSTRACT

A grinding lamella 1 for being arranged on a grinding wheel 19 which is rotatingly drivable around an axis of rotation, comprising an outer edge 2 which is at least partially convex, an inner edge 3 which is at least partially concave, a front edge 4 which connects together the outer edge 2 and the inner edge 3 on the front side of the grinding lamella 1, and a rear edge 5 which connects together the outer edge 2 and the inner edge 3 on a rear side of the grinding lamella 1, wherein the front edge 4 is longer than the rear edge 5 and wherein the outer edge 2 is longer than the inner edge 3.

19 Claims, 3 Drawing Sheets

(56) References Cited

U.S. PATENT DOCUMENTS

| | | | | |
|---|---|---|---|---|
| 5,643,068 | A * | 7/1997 | Ward, Sr. | 451/526 |
| 5,871,391 | A * | 2/1999 | Pryor | 451/9 |
| 6,071,176 | A * | 6/2000 | Kruis | 451/5 |
| 6,089,957 | A * | 7/2000 | Shibata | 451/41 |
| 6,368,187 | B2 * | 4/2002 | Wentworth et al. | 451/28 |
| 6,582,289 | B1 * | 6/2003 | Eisenberg | 451/548 |
| 6,595,842 | B2 * | 7/2003 | Misiura | 451/528 |
| 7,004,829 | B2 * | 2/2006 | Keuler | 451/466 |
| 7,727,056 | B2 * | 6/2010 | Gilles | 451/465 |
| 8,152,422 | B2 * | 4/2012 | Bretschneider et al. | 409/193 |
| 8,360,830 | B2 * | 1/2013 | Klug | 451/529 |
| 8,411,288 | B2 * | 4/2013 | Schneider et al. | 356/621 |
| D702,269 | S * | 4/2014 | Eisenblatter | D15/126 |
| 2001/0053659 | A1 * | 12/2001 | Shibata | 451/42 |
| 2002/0022436 | A1 * | 2/2002 | Mizuno et al. | 451/10 |
| 2002/0115389 | A1 * | 8/2002 | Robinson et al. | 451/43 |
| 2004/0106358 | A1 * | 6/2004 | Tsao et al. | 451/8 |
| 2004/0230335 | A1 * | 11/2004 | Gerding et al. | 700/163 |
| 2009/0068938 | A1 | 3/2009 | Klug | |
| 2009/0088054 | A1 * | 4/2009 | Gilles | 451/537 |
| 2011/0257930 | A1 * | 10/2011 | Gourraud | 702/150 |

FOREIGN PATENT DOCUMENTS

| | | | |
|---|---|---|---|
| EP | 2335877 | A2 | 11/2010 |
| RU | 89016 | U1 | 11/2009 |
| WO | 2007101589 | A2 | 9/2007 |
| WO | 2012055671 | A1 | 5/2012 |
| WO | WO 2012150152 | A2 * | 11/2012 |

* cited by examiner

GRINDING LAMELLA FOR ARRANGEMENT ON A GRINDING WHEEL WHICH CAN BE DRIVEN IN ROTATION ABOUT AN AXIS OF ROTATION

The invention relates to a grinding lamella for being arranged on a grinding wheel rotatingly drivable around an axis of rotation (D), which grinding lamella comprises an outer edge which is at least partially convex in shape; an inner edge which is at least partially concave in shape; a front edge which connects the outer edge and the inner edge on a front side of the grinding lamella, and a rear edge which connects the outer edge and the inner edge on a rear side of the grinding lamella. Furthermore, the invention relates to a grinding wheel with at least one carrier element and a plurality of such grinding lamellae which partially overlap one another and which, together, form an annular shape. The invention also relates to a cutting pattern for such grinding lamellae.

Such grinding wheels provided with a plurality of grinding lamellae are placed onto a driving machine for the purpose of grindingly machining workpiece surfaces. Different embodiments of such grinding wheels and grinding lamellae are known from the state of the art.

EP 1 142 673 B1 shows a grinding lamella of the initially mentioned type which comprise two parallel edges and between same, they comprise a convex and a concave third and fourth edge. The grinding lamellae are positioned on an annular carrier portion of a carrier so as to overlap like roof tiles.

DE 295 10 727 U1 describes a grinding wheel which comprises a plate-shaped carrier which is centred on an axis and is rotatable around same, having a hub portion which is arranged around said axis and having an annular carrier portion which is arranged around said hub portion. The hub portion comprises a bore to allow the passage of a fixing element for being fixed to an operating spindle of a machine. On the carrier portion there is provided an annular covering which is formed of individual grinding lamellae and which is fixed by a glue or resin. The grinding lamellae are trapezoidal in shape; they overlap like roof tiles and are arranged on the annular carrier portion. Because the grinding lamellae have a trapezoidal shape, they cannot be cut off from a continuous strip during the subsequent operating sequence. Furthermore, it is necessary to provide a large number of such grinding lamellae to cover the annular carrier portion, which results in a relatively large positioning angle for each individual grinding lamella and as a result, the grinding wheel is relatively thick across its entire cross-section.

It is the object of the present invention, on the one hand, to provide a grinding lamella the production of which results in a minimum amount of cutting scrap and, on the other hand, to provide a grinding wheel which comprises a high degree of overlap of the grinding lamellae in the rim region.

The objective is achieved by providing a grinding lamella for being arranged on a rotatingly drivable grinding wheel, which comprises an outer edge which is at least partially convex in shape; an inner edge which is at least partially concave in shape; a front edge which connects the outer edge and the inner edge on a front side of the grinding lamella; and a rear edge which connects the outer edge and the inner edge on a rear side of the grinding lamella, wherein the front edge is longer than the rear edge and wherein the outer edge is longer than the inner edge.

The advantage of the inventive grinding lamellae is that, in the rim region, there is achieved a maximum degree of overlap of a grinding wheel comprising such grinding lamellae, i.e. in the region where, during the operation of the tool, the maximum speeds occur, which region constitutes the main operating zone. This means that in the region where the highest loads occur (at the large diameter) most of the material is available, whereas in those regions where only a small amount of material is removed (at the small diameter) there is less grinding material. This results in a long service life of the grinding wheel, which is achieved by relatively small grinding lamellae which permit a thick grinding lamella package such as it is necessary for some applications.

Furthermore, the objective is achieved by providing a grinding wheel with at least one carrier element and with a plurality of inventive grinding lamellae which partially overlap one another and which, together, have an annular shape.

In addition, the objective is achieved by providing a cutting pattern for cutting material or strip for producing inventive grinding lamellae, wherein the grinding lamellae are arranged in rows so as to adjoin one another, with each two adjoining grinding lamellae being arranged in a row in a way so as to be rotated relative to one another by 180 degrees, and are formed so as to be point-symmetric relative to one another.

The designations of the edges of a grinding lamella refer to the grinding lamella package consisting of a plurality of inventive grinding lamellae, with the grinding lamella package being annularly arranged on the finished grinding wheel. The outer edge is thus arranged at the outer circumferential rim of the grinding lamella package and of the grinding wheel respectively, the inner edge is arranged at the inner circumferential rim of the grinding lamella package, the front edge—if viewed in the direction of rotation of the grinding wheel—at the front and the rear edge—if viewed in the direction of the grinding wheel—at the rear.

The rear edge is the edge of the individual grinding lamella, which edge is visible in the grinding lamella package and, because it is the working edge during the grinding operation, it is preferably straight-lined. The front edge is preferably also straight-lined.

In order to achieve a grinding lamella package which is as circular-ring-shaped as possible, the outer edge, at least along part of its length, comprises a convex outer edge portion, with the inner edge, at least along part of its length, comprising a concave inner edge portion, with the convex outer edge portion and the concave inner edge portion comprising the same radius. The latter is important for ensuring that the grinding lamellae are produced with the smallest possible amount of cutting scrap material when these are cut out of a strip, with a convex outer edge portion of a grinding lamella resting against a concave inner edge portion of an adjoining grinding lamella.

Because, between the arched portion of the outer edge and the corner in the transition between the outer edge and the front edge, there is provided a straight outer edge portion, it is possible to provide the outer edge with a longer length in order to make available as much grinding material as possible at the outer circumferential rim of the grinding lamella package.

This situation can be improved in that a further straight-lined outer edge portion can be provided between the convex outer edge portion and a corner in the region of transition between the outer edge and the rear edge.

The inner edge can be concavely formed with a constant radius along its entire length, so that the inner circumferential rim of the grinding lamella package is circular-ring-shaped.

The grinding lamellae are preferably glued to the carrier element, for example by resin.

The rear edges of the grinding lamellae are preferably arranged radially with reference to the axis of rotation. Furthermore, the grinding lamellae are preferably designed in such a way that an angle enclosed by the front edge and the rear edge of the grinding lamella is greater than an angle enclosed by an imaginary radius referring to the axis of rotation and extending through a corner between the inner edge and the front edge, and the rear edge. In this way, too, it is achieved that on the outside more grinding material is available.

The outer edges of the grinding lamellae are preferably arranged on the carrier element in such a way that they form an outer circumferential rim of the grinding wheel.

The carrier element is preferably plate-shaped and can consist of a metal, a resin-bonded glass fiber fabric or plastics, more particularly vulcanized fiber.

The carrier element preferably comprises an annular rim portion for fixing the grinding lamellae, and an inner hub portion, with the hub portion being provided with a bore for fixing the grinding wheel to a driving machine.

The fact that two adjoining grinding lamellae are arranged in a row of the cutting pattern so as to be rotated in pairs by 180 degrees, as well the point-symmetrical design of the grinding lamellae allow all the grinding lamellae to be identical in shape and make it possible for a plurality of rows to be cut side by side out of a strip of grinding material, without there occurring any cutting scrap between the rows or between adjoining grinding lamellae in a row.

The cutting pattern is preferably designed in such a way that each two adjoining grinding lamellae, which abut one another via their rear edges, form two rim edges of the row, with the rim edges each comprising a concave edge region and a convex edge region between which there are provided straight-lined edge regions.

Furthermore, each rim edge can form the inner edge of one of the two adjoining grinding lamellae and the outer edge of the other one of the two adjoining grinding lamellae.

A preferred embodiment of the invention is explained in greater detail with reference to the following drawings wherein FIG. 1 is a plan view of an inventive grinding lamella.

Figure 1:
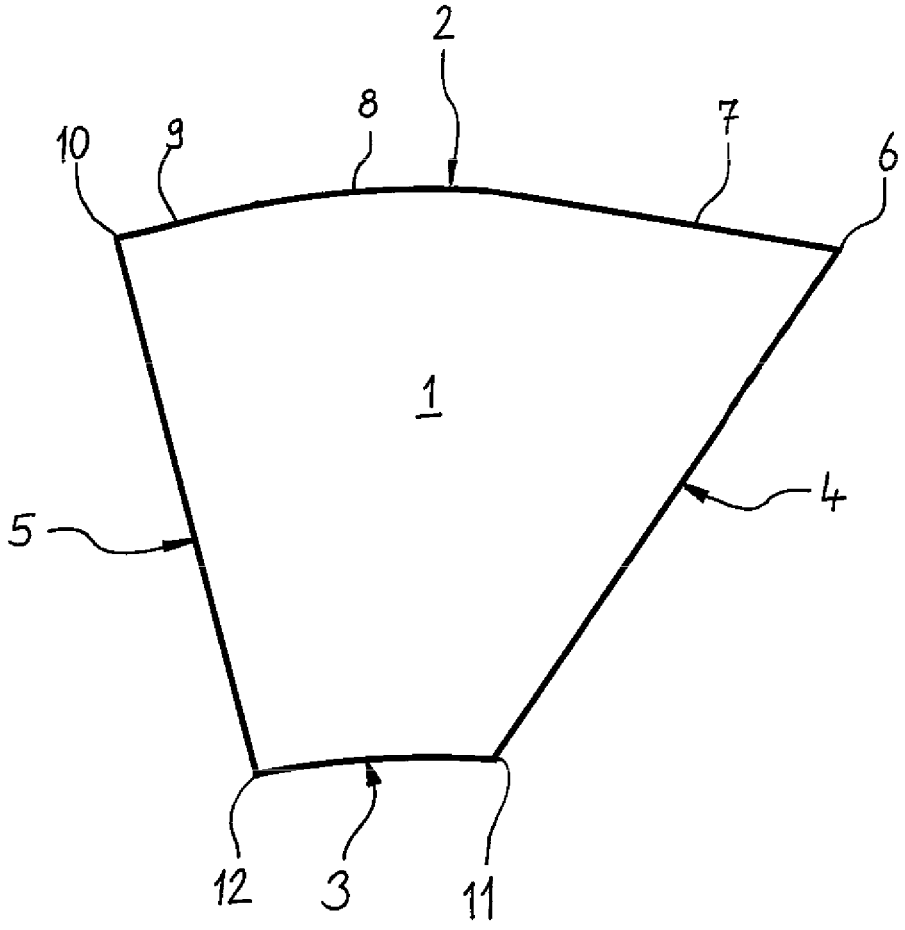

FIG. 1 is a plan view of an inventive grinding lamella with an outer edge 2, an inner edge 3, a front edge 4 and a rear edge 5. The designations of the edges 3, 4, 5, 6 of the grinding lamella 1 are derived from the arrangement of the grinding lamella 1 on a carrier element 15 of a grinding wheel 19. The outer edge 2 is thus arranged at an outer circumferential rim of the grinding wheel 19; the inner edge 3 points inwardly towards a hub portion 18 of the carrier element 15, the front edge 4 is arranged in a direction of rotation R of the grinding wheel 19 around the axis of rotation in front, and the rear edge 5 accordingly at the rear.

The outer edge 2 comprises a plurality of portions/regions, with a straight-lined outer edge portion 7 starting from a first corner 6 between the outer edge 2 and the front edge 4. This is adjoined by a convex outer edge portion 8 which is followed by a straight-lined outer edge portion 9 which ends at a second corner 10 between the outer edge 2 and the rear edge 5.

Along its entire length, i.e. between a third corner 11 between the front edge 4 and the inner edge 3 and a fourth corner 12 between the rear edge 5 and the inner edge 3, the inner edge 3 is fully concave along its entire length. The entire inner edge 3 thus forms a concave inner edge portion.

The front edge 4 and the rear edge 5 are both straight-lined along their entire length. The front edge 4 is longer than the rear edge 5, with the front edge 4 and the rear edge 5 forming an angle relative to one another, which angle opens towards the outer edge 2.

Figure 2:
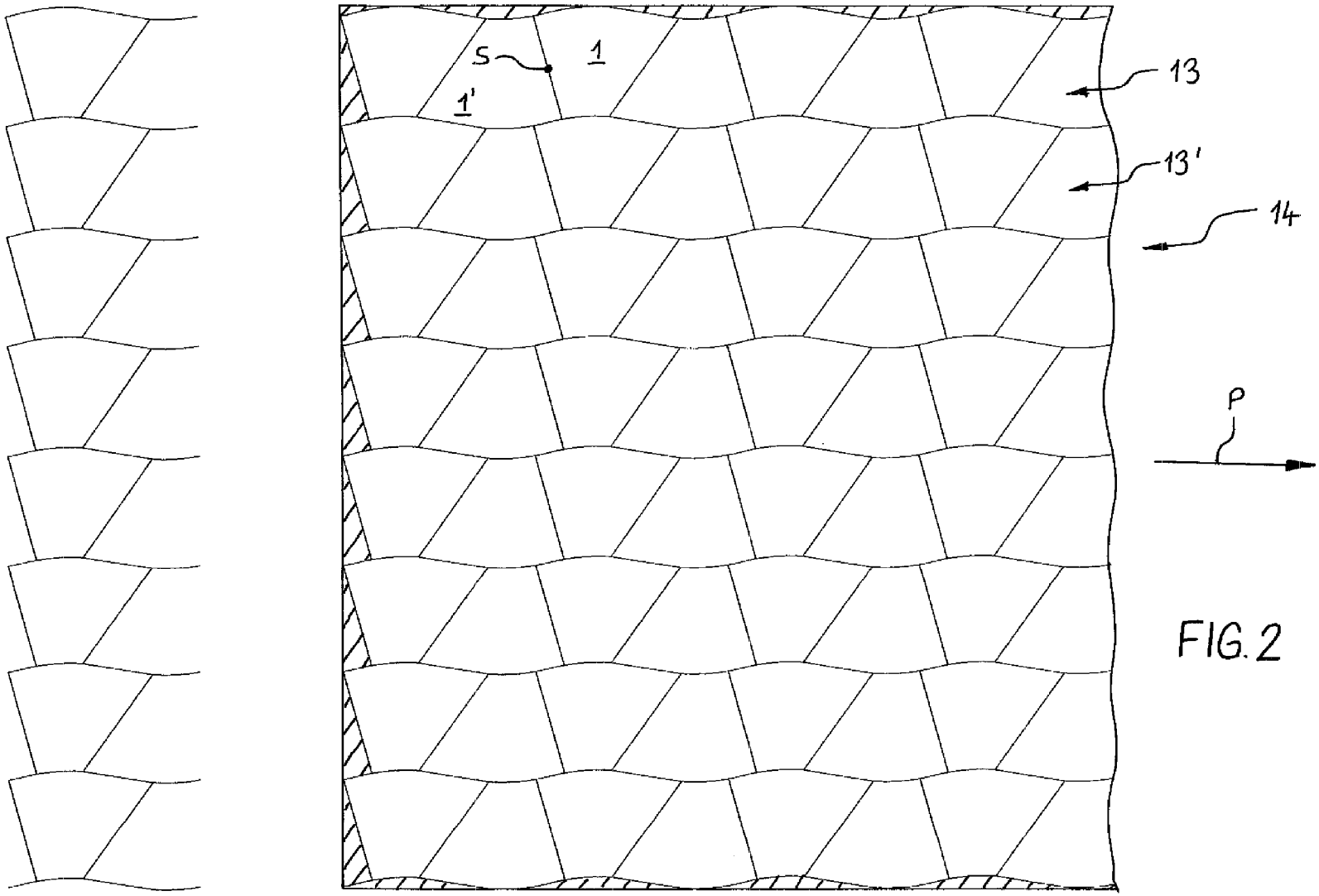
FIG. 2 shows an inventive cutting pattern.

FIG. 2 shows a strip 14 consisting of a grinding material which extends in the direction of the arrow P and on which there is shown the cutting pattern for producing the grinding lamellae out of the strip 14. The grinding lamellae 1 to be cut out are arranged in rows 13 next to one another. Each two adjoining grinding lamellae 1 in a row 13 are arranged so as to be rotated relative to one another by 180 degrees, wherein two adjoining grinding lamellae 1 abut one another either by their front edges 4 or their rear edges 5. To avoid the occurrence of any cutting scrap while the grinding lamellae are being cut out, the grinding lamellae 1 are arranged symmetrically relative to one another in pairs. In the arrangement shown in FIG. 2, the two grinding lamellae 1, 1' emphasized by way of example are designed point-symmetrically relative to the symmetry point S. This applies to all the adjoining pairs of grinding lamellae 1 in a row 13. Furthermore, all grinding lamellae 1 are identical relative to one another, which also applies to the grinding lamellae 1 of different rows 13.

As the strip 14 comprises straight-lined rim regions, cutting scrap occurs in the hatched area only.

Figure 3:
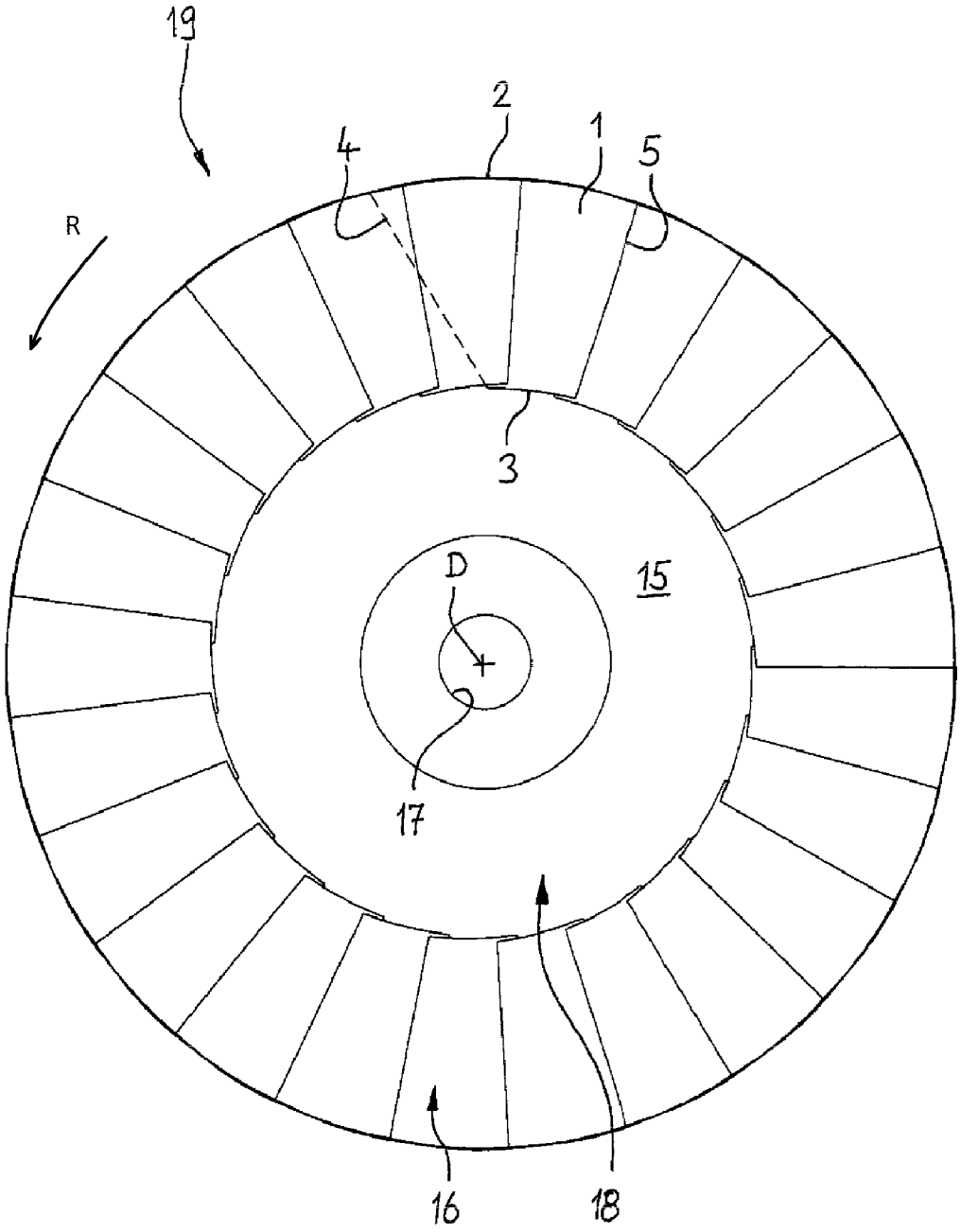
FIG. 3 shows an inventive grinding wheel.

FIG. 3 is a plan view of a grinding wheel with inventive grinding lamellae 1. For one of the grinding lamellae 1 there are shown, by way of example, the covered visual edges. The individual grinding lamellae are arranged so as to partially overlap in the form of a circular-ring-shaped grinding lamella package on a carrier element 15 and glued to the carrier element 15. The carrier element 15 comprises a carrier portion 16 which is also annular in shape and to which the grinding lamellae 1 are glued. Furthermore, the carrier element 15 comprises an inner hub portion 18 in which there is provided a bore 17 by means of which the grinding wheel 19 can be fixed to a driving machine.

Because the individual grinding lamellae partially overlap, the front edges 4 of the grinding lamellae 1 are hidden underneath the subsequent grinding lamella 1. The rear edge 5 is visible and delimits the operating range of the grinding lamella 1 which can be used on the face side of the wheel. The rear edge 5 is arranged radially relative to the axis of rotation D of the grinding wheel 19. However, in principle it is also conceivable for the rear edge 5 to slightly deviate from an imaginary radius on the axis of rotation D. On the other hand, the front edge 4 is not arranged radially relative to the axis of rotation D, but at an angle in such a way that the angle between the front edge 4 and the rear edge 5 is greater than it would be if the front axle was arranged radially. It is thus ensured that the inner edge 3 is clearly shorter than the outer edge 2 of the grinding lamella 1. The radian measure of the angle across which the inner edge 3 extends with reference to the axis of rotation D is thus smaller than the radian measure of the angle across which the outer edge 2 extends with reference to the axis of rotation D. In consequence, more material for the grinding lamella 1 is provided at the outer rim of the grinding wheel 19 than an the inner rim of the grinding lamella package which consists of a plurality of grinding lamellae 1. In consequence, more grinding material is provided in the region in which there occur higher circumferential speeds, more material waste and thus a higher degree of wear.

LIST OF REFERENCE NUMBERS

1 grinding lamella
2 outer edge
3 inner edge

4 front edge
5 rear edge
6 first corner
7 straight-lined outer edge portion
8 convex outer edge portion
9 straight-lined outer edge portion
10 second corner
11 third corner
12 fourth corner
13 row
14 strip
15 carrier element
16 rim portion
17 bore
18 hub portion
19 grinding wheel
D axis of rotation
P direction of arrow
S symmetry point

The invention claimed is:

1. A grinding lamella for being arranged on a grinding wheel rotatingly drivable around an axis of rotation comprising:

an outer edge which is at least partially convex in shape, an inner edge which is at least partially concave in shape, a front edge which connects the outer edge and the inner edge on a front side of the grinding lamella, and a rear edge which connects the outer edge and the inner edge on a rear side of the grinding lamella, characterized in that the front edge is longer than the rear edge and that the outer edge is longer than the inner edge, and wherein either:

(1) the front edge and the rear edge are straight-lined and enclose an angle;

(2) at least along part of its length, the outer edge comprises a convex outer edge portion, and that at least part of its length, the inner edge comprises a concave inner edge portion, wherein the convex outer edge portion and the concave inner edge portion comprise the same radius;

(3) between the convex outer edge portion and a corner, in the region of transition between the outer edge and the front edge, there is provided a straight-lined outer edge portion;

(4) between the convex outer edge portion and a corner, in the region of transition between the outer edge and the rear edge, there is provided a straight-lined outer edge portion; or (5) the entire inner edge is formed so as to be concave with a constant radius.

2. A grinding lamella according to claim 1, characterized in that the front edge and the rear edge are straight-lined and enclose an angle.

3. A grinding lamella according to claim 1, characterized in that at least along part of its length, the outer edge comprises a convex outer edge portion, and that at least part of its length, the inner edge comprises a concave inner edge portion, wherein the convex outer edge portion and the concave inner edge portion comprise the same radius.

4. A grinding lamella according to claim 1, characterized in that between the convex outer edge portion and a corner, in the region of transition between the outer edge and the front edge, there is provided a straight-lined outer edge portion.

5. A grinding lamella according to claim 1, characterized in that between the convex outer edge portion and a corner, in the region of transition between the outer edge and the rear edge, there is provided a straight-lined outer edge portion.

6. A grinding lamella according to claim 1, characterized in that the entire inner edge is formed so as to be concave with a constant radius.

7. A grinding wheel with at least one carrier element and with a plurality of grinding lamellae according to claim 1, which lamellae partially overlap with one another and which together form an annular shape.

8. A grinding wheel according to claim 7, characterized in that the grinding lamellae are glued to the carrier element.

9. A grinding wheel according to claim 7, characterized in that with reference to the axis rotation, the rear edges of the grinding lamellae are arranged radially.

10. A grinding wheel according to claim 7, characterized in that the grinding lamellae are arranged in such a way that an angle enclosed by the front edge and the rear edge of the grinding lamellae is greater than an angle which is enclosed by an imaginary radius referring to the axis of rotation and extending through a corner between the inner edge and the front edge and by the rear edge.

11. A grinding wheel according to claim , characterized in that the convex outer edge portions of the grinding lamellae form an outer circumferential rim of the grinding wheel.

12. A grinding wheel according to claim 7, characterized in that the carrier element is plate-shaped.

13. A grinding wheel according to claim 7, characterized in that the carrier element comprises an annular rim portion for fixing the grinding lamellae and an inner hub portion, wherein in the hub portion there is provided a bore for fixing the grinding wheel to a driving machine.

14. A grinding wheel according to claim 7, characterized in that the plate-shaped carrier element is made of metal, a resin-bonded glass fiber texture, a fiber material or plastics, more particularly vulcanized fiber.

15. A cutting pattern for cutting the material or a strip of material for producing grinding lamellae according to claim 1, characterized in that the grinding lamellae are arranged in rows which adjoin one another side by side, and that each two adjoining grinding lamellae of one row are arranged so as to be rotated relative to one another by one hundred eighty degrees and are formed so as to be point-symmetric relative to one another.

16. A cutting pattern according to claim 15, characterized in that each two adjoining grinding lamellae which abut one another by means of their rear edges form two rim edges of the row, wherein the rim edges each comprise a concave edge region and a convex edge region between which there are provided straight-lined edge regions.

17. A cutting pattern according to claim 15, characterized in that each rim edge forms the inner edge of one of the two adjoining grinding lamellae and the outer edge of the other one of the two adjoining grinding lamellae.

18. A grinding lamella for being arranged on a grinding wheel rotatingly drivable in a direction of rotation around an axis of rotation comprising:

an outer edge which is at least partially convex in shape, an inner edge which is at least partially concave in shape, a front edge which connects the outer edge and the inner edge on a front side of the grinding lamella that faces toward the direction of rotation, and a rear edge which connects the outer edge and the inner edge on a rear side of the grinding lamella that faces away from direction of rotation, characterized in that the front edge is longer than the rear edge and that the outer edge is longer than the inner edge.

19. A grinding wheel rotatingly drivable around an axis of rotation comprising:

a carrier, and a plurality of grinding lamellae supported on the carrier, wherein each of the plurality of grinding lamellae includes:

an outer edge which is at least partially convex in shape, an inner edge which is at least partially concave in shape, a front edge which connects the outer edge and the inner edge on a front side of the grinding lamella, and a rear edge which connects the outer edge and the inner edge on a rear side of the grinding lamella, characterized in that the front edge is longer than the rear edge and that the outer edge is longer than the inner edge, wherein each of the front edges of the plurality of grinding lamellae is disposed adjacent to the carrier, and each of the rear edges of the plurality of grinding lamellae is spaced apart from the carrier.

* * * * *

UNITED STATES PATENT AND TRADEMARK OFFICE

CERTIFICATE OF CORRECTION

PATENT NO. : 9,056,388 B2
APPLICATION NO. : 13/881904
DATED : June 16, 2015
INVENTOR(S) : Zoltan Atila Daday et al.

It is certified that error appears in the above-identified patent and that said Letters Patent is hereby corrected as shown below:

In the Claims

Column 6, Claim 11, Line 20, after claim insert --7--.

Signed and Sealed this
Thirteenth Day of October, 2015

Michelle K. Lee

Michelle K. Lee
*Director of the United States Patent and Trademark Office*